US006056653A

United States Patent [19]

Boldin

[11] Patent Number: 6,056,653

[45] Date of Patent: May 2, 2000

[54] TENNIS EXERCISE DEVICE

[76] Inventor: Alexander Boldin, Memmingerstrasse 69, D-87439 Kempten, Germany

[21] Appl. No.: 09/135,900

[22] Filed: Aug. 18, 1998

[30] Foreign Application Priority Data

Aug. 19, 1997 [DE] Germany ..... 297 14 841 U

[51] Int. Cl.[7] ..... A63B 69/38

[52] U.S. Cl. ..... 473/461; 473/474

[58] Field of Search ..... 473/257, 258, 473/259, 260, 461, 415, 459, 474, FOR 112, FOR 115, 422

[56] References Cited

U.S. PATENT DOCUMENTS 3,231,271 1/1966 Murphy .

4,105,204 8/1978 Koenig .

FOREIGN PATENT DOCUMENTS 84 27 527 1/1985 Germany .

479561 1/1938 United Kingdom .

*Primary Examiner*—Sebastiano Passaniti

*Attorney, Agent, or Firm*—Flynn, Thiel, Boutell & Tanis, P.C.

[57] ABSTRACT

An exercise device for learning to guide a tennis racquet which includes an upwardly open ball track that is curved approximately like a horseshoe from a top view, and a support device by which the ball track is supported inclined on the ground in such a manner that the lowermost point of the ball track lies in an apex area of the curved track.

17 Claims, 6 Drawing Sheets

TENNIS EXERCISE DEVICE

FIELD OF THE INVENTION

The invention relates to an exercise device for learning to guide a tennis racquet during forehand and backhand top-spin strokes.

BACKGROUND OF THE INVENTION

An exercise device for learning to guide a tennis racquet is known from the German Gebrauchsmuster 8427527. This exercise device includes a guide rail following a path horizontal in the rear and rising to the front, on which the head of a tennis racquet is supposed to be guided in order to learn a defined stroke movement. The guide rail is forked in its rear area. Two branches are in this manner created, one of which is supposed to serve the learning of the forehand movement and the other one the learning of the backhand movement. The exercise device has two stops for the tennis racquet at its forked ends and a roller at its front end. The roller is supposed to lend the tennis racquet a tilting movement when leaving the guide rail. This guide rail is mounted on an elevationally adjustable stand.

SUMMARY OF THE INVENTION

The basic purpose of the invention is to provide an exercise device for learning to guide a tennis racquet, with which an increased success during learning to guide the racquet can be achieved. It is in particular the purpose of the present invention to provide an exercise device which makes it easier to learn the correct sequence of movement when stroking a tennis ball with forehand and backhand top-spin strokes.

This purpose is attained according to the invention with an exercise device which includes an upwardly open ball track that is curved approximately like a horseshoe in the top view, and a support device, whereby the ball track can be supported inclined on the ground by means of the support device in such a manner that the lowermost point of the ball track lies in the apex area. Thus the exercise device of the invention is distinguished in particular by three characteristics, which in cooperation with one another enable quick success when learning the correct sequence of movement. According to a first important characteristic of the invention an upwardly open ball track serves to guide the tennis racquet. This enables the learning of the sequence of movement carried out during the stroke of a tennis ball, whereby in spite of a significantly slowed down sequence of movement for the purpose of the exercise ("slow-motion") a contact with the ball is possible. The tennis ball is moved along in the ball track with the racquet, which is moved resting with its head on the ball track. While right from the start the learning of the correct sequence of movement with ball contact is possible, the feeling for the ball is improved and the learning of the correct racquet position is made easier. The movement of the racquet can be accelerated toward the end of each cycle of movement while obtaining contact with the ball. The cycle of racquet movement, as such, can be accelerated progressively, corresponding with the progress, without having any influence on the contact with the ball.

The second important characteristic is the design of the ball track in such a manner that it is curved approximately like a horseshoe in the top view. Also this characteristic favors the learning of the natural sequence of movement since the head of the racquet during the course of the "loop" carried out during the stroke is placed onto the ball track already prior to the point of contact of the ball on the racquet. This is valid for both the forehand stroke and also the backhand stroke. The guiding of the racquet head on the ball track starts, in each case, in the extent of the one branch of the ball track and extends over the apex and the other branch of the ball track. The exercise device of the invention acts in this manner against a "tearing" of the racquet. Rather, it trains to carry out a harmonic stroke, during which the racquet is pulled in an ideal loop through the point of contact of the ball on the racquet.

According to a third important characteristic of the invention, the ball track is supported inclined on the ground by means of the support device in such a manner that its lowermost point lies in the apex area. A tennis ball received in the ball track thus assumes, due to the force of gravity, a position lying in the apex area of the ball track each time a ball is placed on the track. During repeated sequences of movement during strokes made by guiding the racquet head along on the ball track, the racquet picks up the tennis ball every time at the same spot. This gives the student the correct feeling for the relationship between the sequence of movement and contact of the ball on the racquet.

The three above-discussed characteristics characterizing the exercise device of the invention enable, in their combination, a particularly quick learning of the correct sequence of movements for forehand and backhand top-spin strokes.

A particularly preferred further development of the exercise device of the invention is characterized in that the ball track is curved three-dimensionally by being approximately S-shaped in the side view with the maximum drop in the apex area between the free ends of the branches. Such a three-dimensional curvature of the ball track is capable of further improving the schooling result and shortening the time needed to learn the correct sequence of movement. Because right from the start, the tennis student slowly guides his tennis racquet with the head on the ball track along the spacially correct sequence of movement. Here too, the invention again utilizes the knowledge that a defined movement can best be learned when it is initially exercised extremely slowly and deliberately, and only little by little the speed is increased.

According to a further preferred development, the free branches of the ball track have open ends. This makes it possible that the tennis ball received by the tennis racquet in the apex area of the ball track and initially rolled along in the ball track is accelerated toward the end of the respective branch of the ball track and leaves the ball track in flight. Also, this characteristic contributes again to an improvement of the success in learning by not only (nondynamically) schooling the path of movement of the racquet head, but by also schooling the dynamics of the sequence of movement. It is particularly advantageous in this connection when the branches of the ball track have an inking, that increases in intensity toward their respective ends. This makes learning the dynamics of the sequence of movement easier by increasing the speed of the tennis racquet in correspondence with the increase of the intensity of the inking of the ball track.

Two again preferred further developments of the invention are distinguished in such a manner that the ball track is not designed symmetrically but rather asymmetrically in the top view. On the one hand, both branches of the ball track are not advantageously equally expansive. Rather it is advantageous that the one branch of the ball track, namely the backhand branch (this is the branch over which the ball is rolled during a backhand stroke), is less expansive (narrower) than the other branch (the forehand branch). Advantageously, both branches of the ball track are not equally long. Rather the one branch, namely the backhand branch, is slightly shorter than the other branch. This is a particularly advantageous exercise device of the invention, in which the forehand branch is designed longer and expanded more than the backhand branch.

The ball track of the exercise device of the invention has advantageously, at least in certain areas, an asymmetrical cross section in that the outer wall has a smaller radius of curvature than the inner wall. The curvature of radius of the outer wall corresponds thereby advantageously essentially with the radius of curvature of the tennis ball or is slightly less than same. This assures an optimum, exactly defined guiding of the tennis ball and prevents the tennis ball from leaving the ball track too easily. In this connection, one must also pay attention to the height of the ball track. The height is advantageously 30% to 40% of the diameter of one tennis ball.

The exercise device of the invention includes, according to a further preferred embodiment, a center unit and two branches of the ball track releasably fastened to the center unit. The center unit, which includes the apex of the ball track, is thereby advantageously supported on a first stand, and the two branches of the ball track are each supported with a further stand. To adjust the exercise device to the dimensions of the body of the tennis student, all three stands are advantageously designed elevationally adjustable. Also the releasable fastening of the individual branches of the ball track to a center unit enables the adjustment of the exercise device to the dimensions of the body of the tennis student by being able to exchange differently formed ball tracks (wider or narrower) with one another. Furthermore, differently designed ball track branches can be connected to the center unit for lefthanders on the one side and righthanders on the other side. Moreover, this modular design of the exercise device of the invention makes its handling and use easier.

Yet another preferred further development of the invention is distinguished in such a manner that adjacent to the area of the apex of the ball track there is provided a ball magazine. From such a ball magazine it is possible to supply, after each stroke, a new tennis ball to the ball track in the area of its apex so that several strokes can be carried out directly one after the other. Once again, the learning of the correct sequence of movement is made easier.

Such a ball magazine can, according to a particularly preferred development of the invention, include a storage track arranged outside of the ball track and lower than the ball track, the storage track being suited to receive a plurality of tennis balls, and being connected to the ball track through a supply track and a ball lifter. Such an arrangement of the storage track is particularly advantageous in view of the fact that the track does not hinder the sequence of movement and in addition can be loaded without the tennis student having to step out of the exercise device. The storage track can thereby be curved in a particular approximately parabolic shape. This results in a particularly compact design of the device of the invention. The outer wall of the ball track has, in the area of the mouth of the supply track, advantageously a recess through which the tennis balls are placed into the ball track. A pivotally supported scoop is advantageously provided for placing the balls from the supply track into the ball track, to which scoop the respective tennis ball is fed by means of a supply track. The scoop can thereby be operated advantageously by means of a lever rotatably supported adjacent to the recess and projecting over the ball track in its base position. The respective lever is thereby operated by the racquet head shortly after the head has received the ball lying ready in the ball track. It is particularly advantageous when two such operating levers are provided, such that the one operates the scoop during forehand strokes and the other during backhand strokes. The respective lever not serving the operation of the racquet head is thereby, when the racquet head is guided through the apex area of the ball track, moved by the racquet head in such a manner that it bridges the recess in the outer wall of the ball track so that the racquet head does not sink into the recess.

Of course, it is also possible to utilize differently designed ball magazines and ball supplies to the ball track within the scope of the invention. For example it is also possible to supply the tennis balls from the ball magazine of the ball track through a hole from below, whereby in this case the supply system includes a feedpipe.

BRIEF DESCRIPTION OF THE DRAWINGS

The invention will be discussed in greater detail hereinafter in connection with the drawings, whereby the individual aspects and advantages of the invention, whether or not they have been discussed above, can be recognized more clearly. All figures of the drawings relate thereby to the same preferred exemplary embodiment of the exercise device of the invention, whereby.

DETAILED DESCRIPTION

Figure 2:
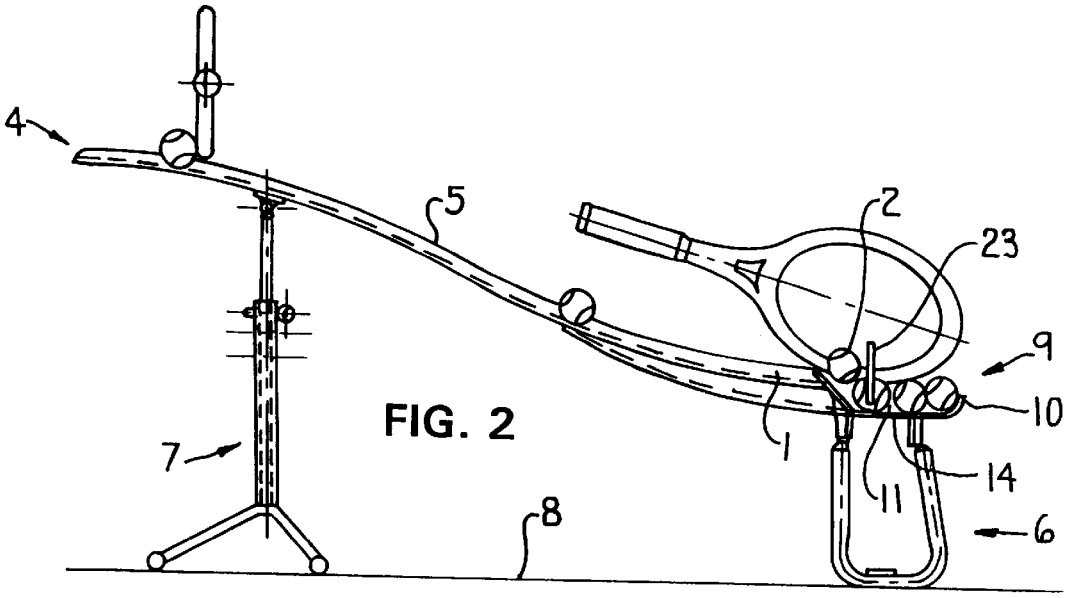
FIG. 2 is a side view.
Figure 1:
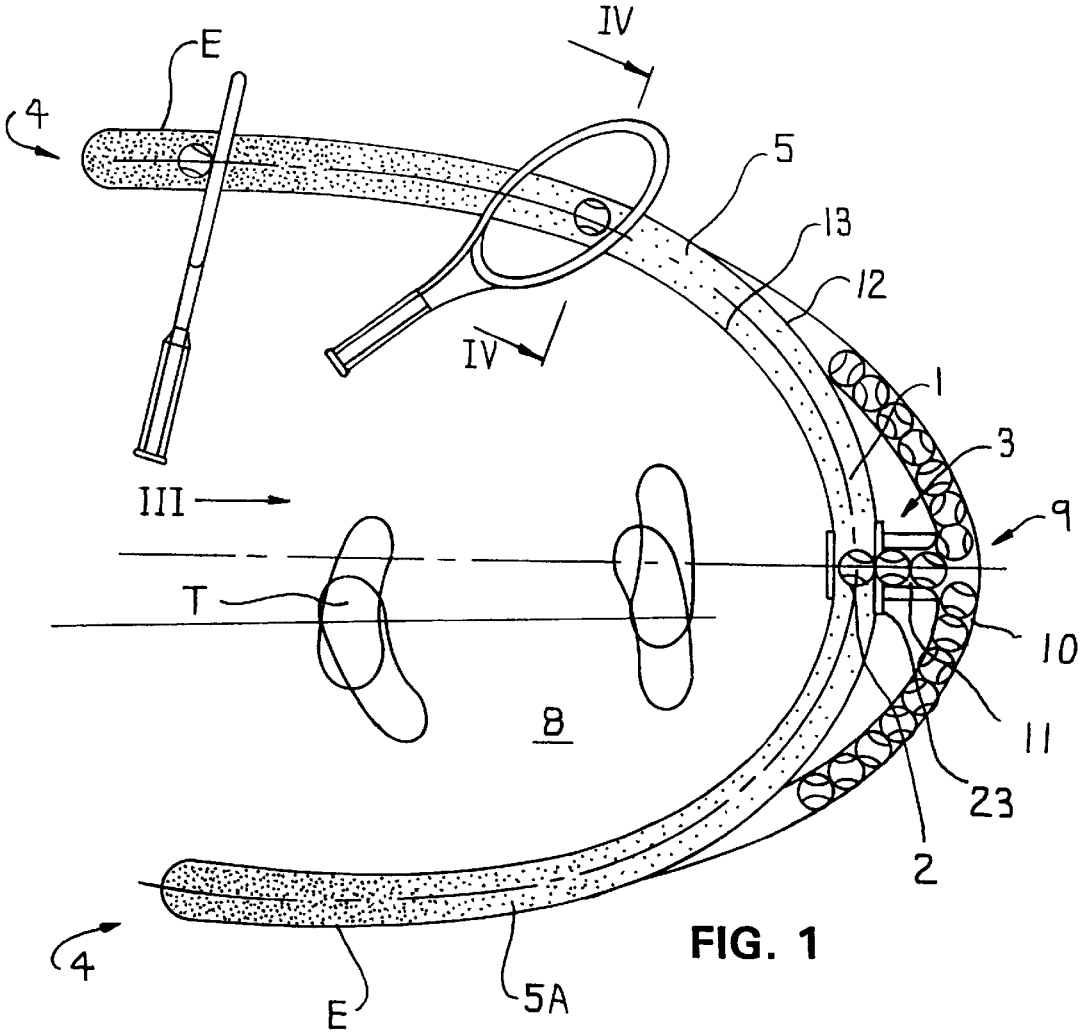
FIG. 1 is a top view.
Figure 3:
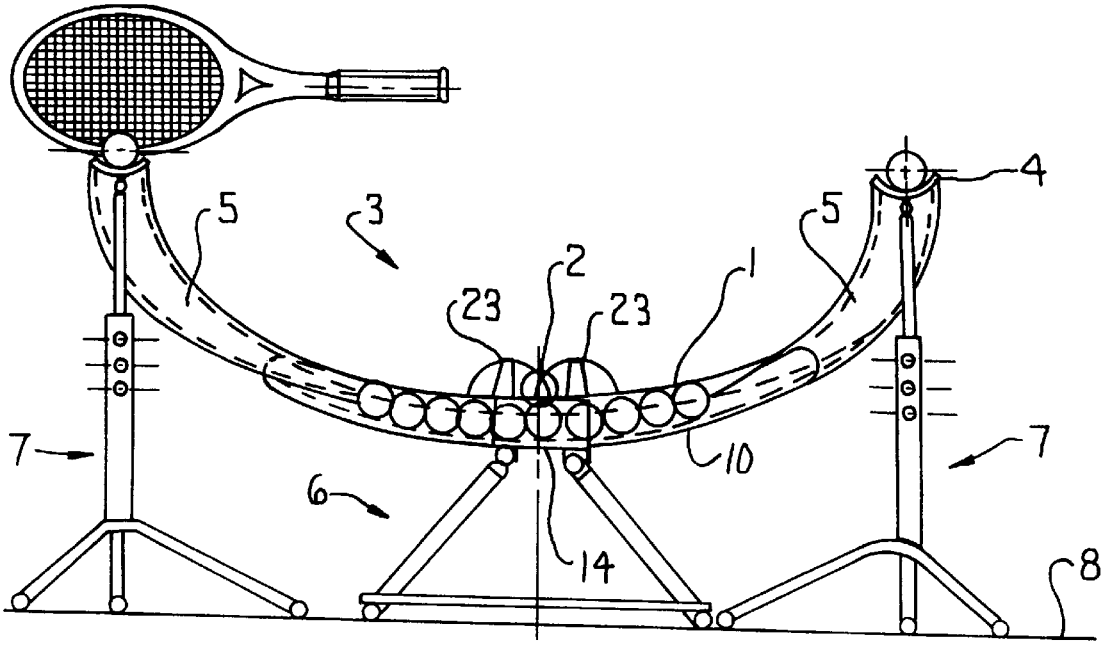
FIG. 3 is a view shown from the rear.
Figure 4:
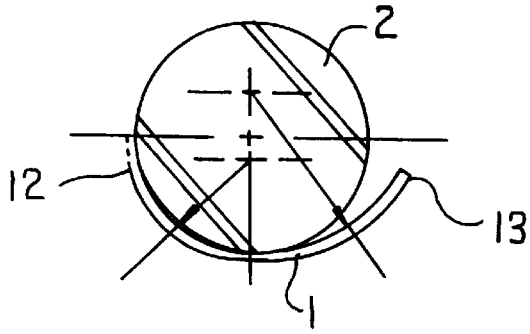
FIG. 4 is a cross-sectional view of the ball track along the line IV—IV of FIG. 1 of the center unit of the exercise device according to FIGS. 1 to 4.

According to the basic design illustrated in FIGS. 1 to 3, the exercise device illustrated in the drawings includes an upwardly open ball track 1, which in the top view is bent approximately like the shape of a horseshoe. The ball track 1 is thereby dimensioned such that a tennis ball 2 is securely guided in the track (see FIG. 4). Ball track 1 is three-dimensionally curved (see FIG. 2) by being approximately S-shaped in the side view with the maximum drop between the apex area 3 and the free ends 4 of the branches 5. The free ends 4 of the two branches 5 of the ball track 1 are open so that a tennis ball 2 can leave the respective branch of the ball track in its extension. The two branches 5 of the ball track 1 have an inking E, which increases in intensity toward the ends 4.

A front stand 6 is provided in the area of the apex 3 of the ball track. Front stand 6 includes essentially two U-shaped curved bars and a connecting web. Each of the two branches 5 of the ball track 1 is supported by a further rear stand 7. These rear stands each include a support base and a telescopic pipe. The front stand 6 and the two rear stands 7 are elevationally adjustable to adjust the height of the ball track 1 above the ground 8 relative to the body mass of the tennis student. Independent of the adjusted height of the ball track 1 above the ground 8, the ball track is aligned in a manner such that the lowermost point of the ball track lies in the area of the apex 3. A tennis ball received in the ball track 1 assumes, based on the force of gravity, a position in the apex area 3 of the ball track 1.

The branch 5 of the ball track 1, in which the tennis ball rolls along when learning the forehand stroke, is designed slightly longer and more expansive than the other branch 5A of the ball track, namely the one in which the tennis ball rolls along when learning the backhand stroke. The exercise device illustrated in the drawings is configured for a right-handed player. A ball magazine 9 is provided in the area of the apex 3 of the ball track. The ball magazine 9 includes a storage track 10, which is arranged outside of the ball track 1 and lower than same. The storage track 10 is connected to the ball track 1 in the apex area 3 through a supply track 11 and a ball lifter 17 (see FIGS. 5 to 7).

Two stepping plates T are part of the exercise device. These are placed on the ground 8 and mark the ideal foot position during the forehand or rather during the backhand stroke. The position of the tennis student in relationship to the exercise device can, in this manner, be reproduced. The stepping plates T have small nails at their undersides which penetrate the ground 8 and prevent a slipping of the stepping plates.

The cross section of the ball track 1 is asymmetrical in this manner so that the outer wall 12 is curved with a lesser radius of curvature than the inner wall 13. According to FIG. 4, the radius of curvature of the outer wall 12 is slightly less than the radius of a tennis ball, whereas the radius of curvature of the inner wall 13 is approximately 50% larger than the radius of a tennis ball.

Figure 5:
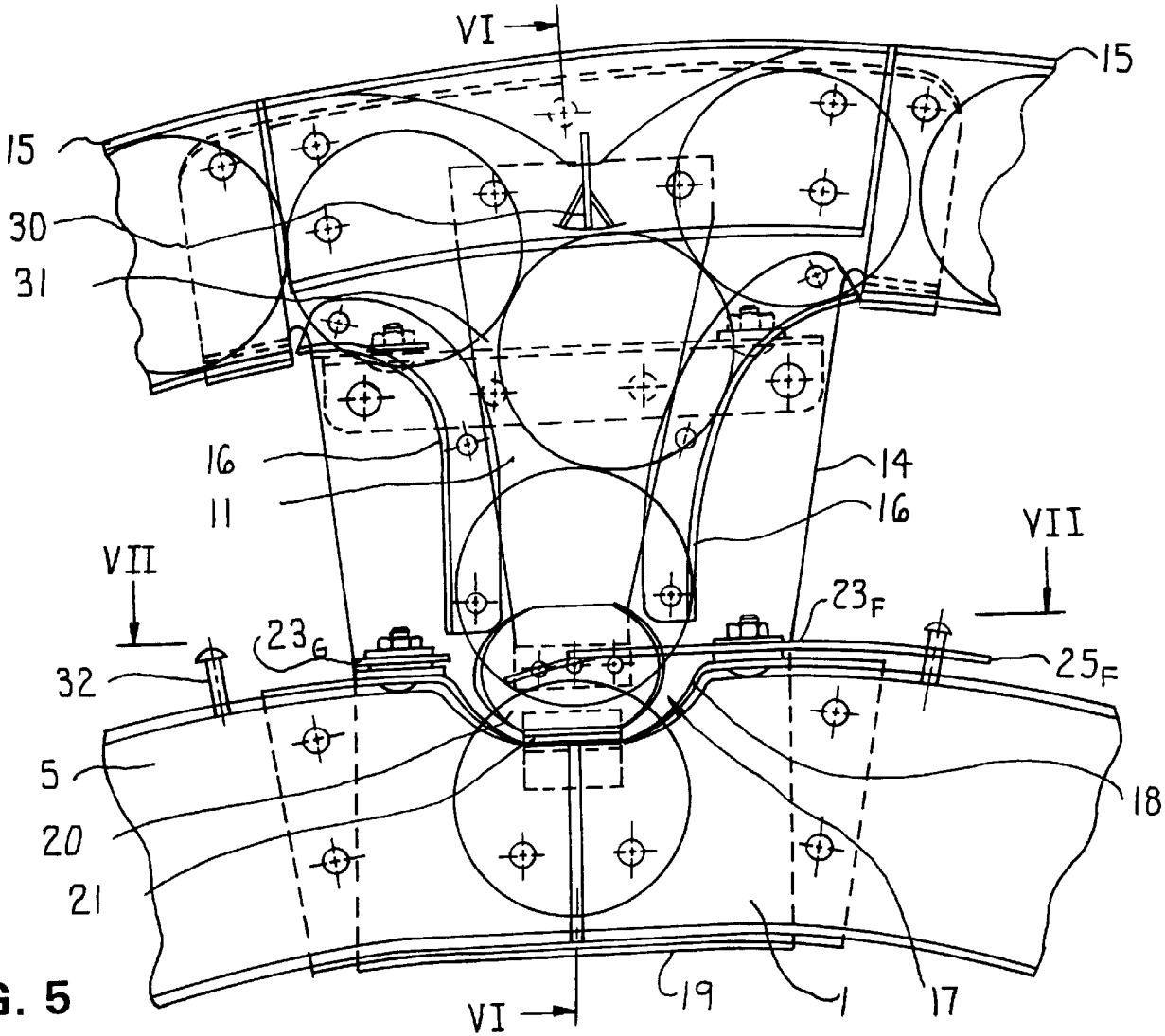
FIG. 5 is a top view.
Figure 6:
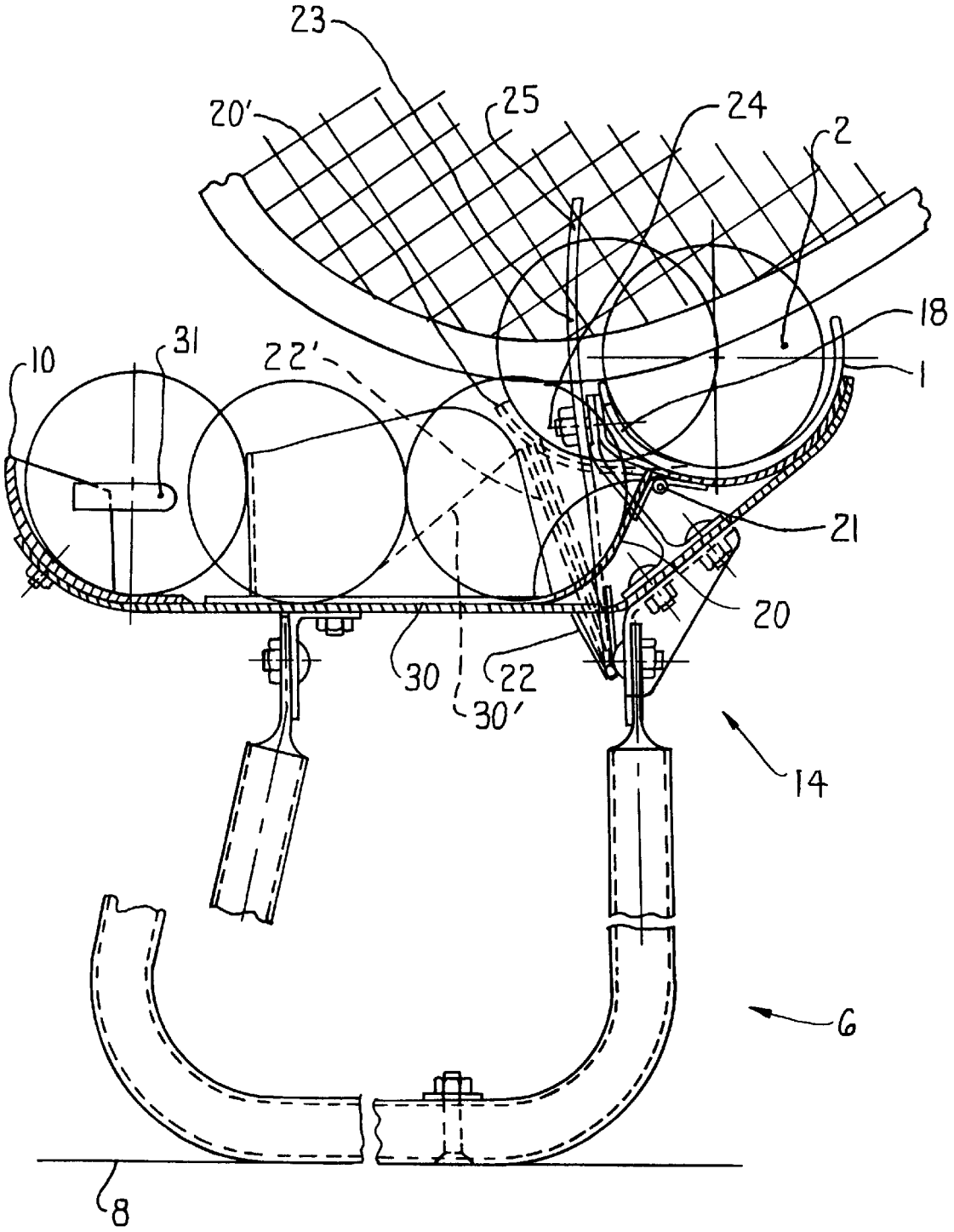
FIG. 6 is a longitudinal cross-sectional view along line VI—VI of FIG. 5.
Figure 7:
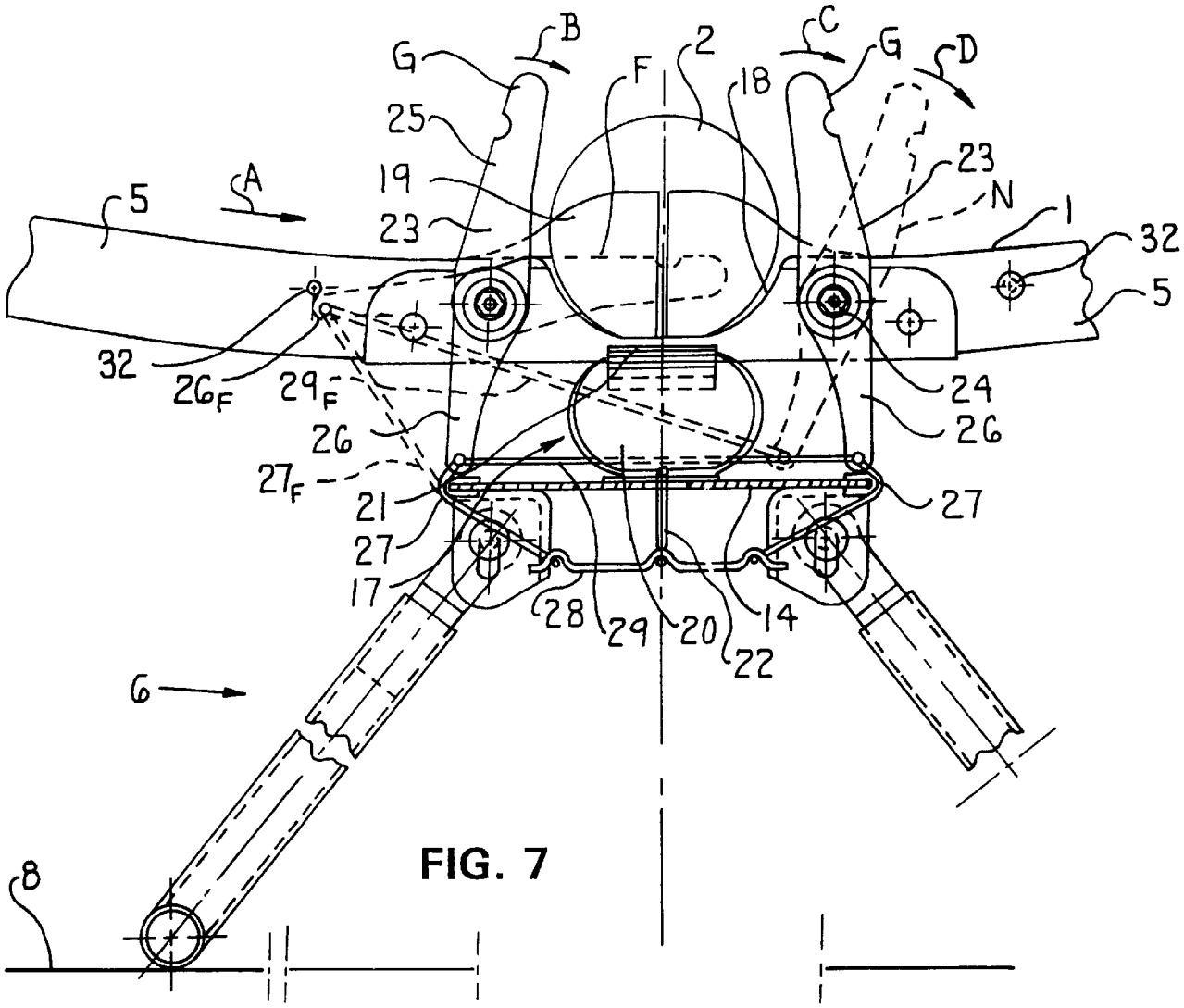
FIG. 7 is a cross-sectional view along the line VII—VII of FIG. 5.

FIGS. 5 to 7 show in detail that the exercise device includes a center unit 14, to which the two branches 5 of the ball track 1 are releasably connected. Furthermore, the two branches 15 of the storage track 10 of the ball magazine 9 are connected to the center unit 14. The supply track 11 is defined on the center unit 14 through two guide bars 16. The supply track 11 extends from the storage track 10 of the ball magazine 9 to a ball lifter 17. The outer wall 12 of the ball track 1 has, in the area of the ball lifter 17, a recess 18 through which the tennis balls are moved into the ball track 1. The oppositely lying, inner wall 13 of the ball track 1 has here an elevation 19, that prevents a tennis ball moved by the ball lifter 17 into the ball track from jumping off inwardly from the ball track.

The ball lifter 17 includes a scoop 20, which is pivotally supported about a horizontal axis aligned transversely with respect to the extent of the supply track 11 by means of a hinge 21. The scoop 20 is pretensioned in its lowermost position, in which a tennis ball supplied through the supply track 11 can roll onto the scoop, by means of an elastic strip 22, which extends between the underside of the scoop 20 and a holding clamp 28.

FIG. 6 shows the scoop 20 both in its lowered position and also (in broke lines) in its raised position, in which a supplied tennis ball rolls off from the scoop and through the recess 18 into the ball track 1. For a better understanding the scoop is identified in the lifted position with reference numeral 20' and the associated elastic strip with reference numeral 22'.

Each operating lever 23 is supported pivotally about an axis 24 on both sides of the recess 18 on the outer wall 12 of the ball track 1. The two operating levers 23 are designed symmetrically and thus mirror each other. They have each two arms, which are essentially opposite one another, namely one first art 25 projecting upwardly beyond the ball track 1 in the base position G (illustrated in full lines in FIG. 7) and an oppositely lying second arm 26. An elastic strip 27 is connected to the second arm 26 of each operating lever 23. The oppositely lying end of elastic strip 27 is fixed to the holding clamp 28. Each operating lever 23 is pretensioned into the upright base position G through the associated elastic strip 27. The second arms 26 of the two operating levers 23 are moveover also among one another connected by an elastic strip 29, the operation of which will be discussed hereinafter.

When the head of a racquet is guided according to the arrow A over the ball track 1 in the area of the central unit 14, then the operating lever 23, which the racquet hits first, is flattened (see arrow B in FIGS. 7), until, in the flat position F illustrated in broken lines, its first arm $\mathbf{25}_F$ bridges the recess 18. Wherever subscripts appear, they represent the same element moved into a different position. The other operating lever is swung according to the arrow C into an inclined position N (illustrated in broken lines in FIG. 7) through the elastic strip $\mathbf{29}_F$ hinged to the second arm $\mathbf{26}_F$. The head of the tennis racquet slides now on the first arm $\mathbf{25}_F$ of the flattened operating lever $\mathbf{23}_F$ over the recess 18, whereby it picks up the waiting tennis ball 2. During continued movement the racquet head frees the flattened operating lever $\mathbf{23}_F$,and the lever swings back into its base position due to the restoring force provided by the elastic strip $\mathbf{27}_F$. The second operating lever $\mathbf{23}_N$ swung into its inclined position N is, at the same time, moved by the racquet head (see arrow D in FIG. 7), whereby the second arm $\mathbf{26}_N$ swings the scoop 20 upwardly (see FIG. 6). The tennis ball, which lines on the scoop 20, moves thereby through the recess 18 into the ball track 1. In order to prevent a tennis ball from rolling underneath the upwardly swung position of the scoop 20' (see FIG. 6), a strip 30 of an elastic material placed in the area of the base of the supply track 11 is connected at its underside to the scoop 20. When the scoop 20 is swung into its upwardly swung position 20', the strip 30 first lying at the base of the supply track 11 assumes the inclined position 30' (see FIG. 6).

Suitable damping means ensure that the operating levers 23 do not bounce back undamped out of their traversed or rather flattened positions represented by F and N in FIG. 7. Moreover stops 32 are used for limiting the movement of the operating levers 23 (see arrow D in FIG. 7).

In the area where the two branches of the storage track come together there is arranged a resilient small plate 31. At the same time, the two guide bars 16 are curved at varying degrees in the area. This arrangement guarantees a priority control in the area of the ball supply so that obstructions do not occur in the area where the two branches come together.

Figure 8:
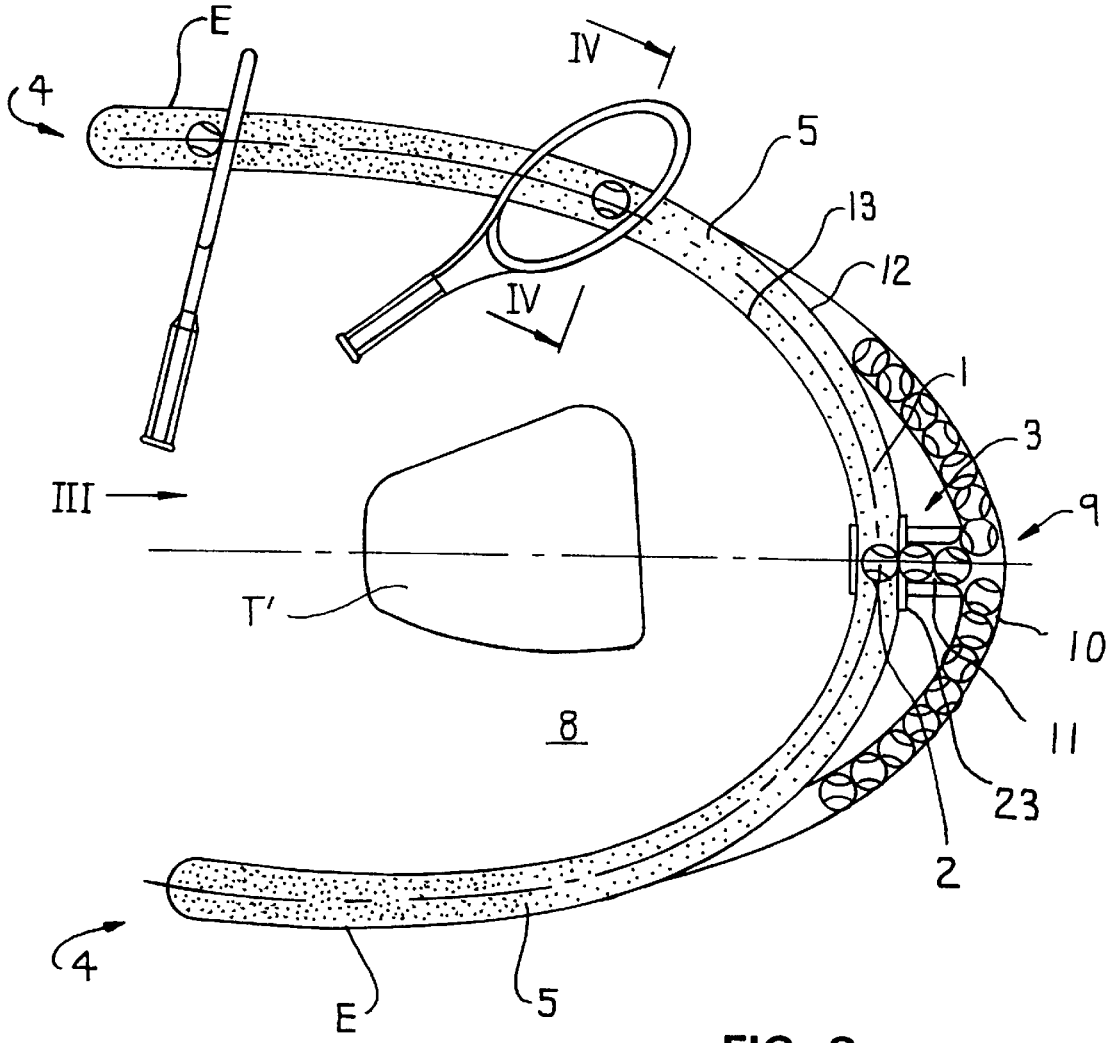
FIG. 8 shows a modification of the exercise device illustrated in FIG. 1.

FIG. 8 shows an exercise device, which different merely in two aspects from the exercise device according to FIG. 1. On the one hand each of the two branches 5 is divided into three differently inked areas, which is shown by the varying shading. The differently inked areas make it easier for the tennis student to learn the sequence of movement, which has a varying characteristic in the three partial areas.

Furthermore, two stepping plates are not placed on the ground 8. Rather one single larger stepping plate T' is provided, which indicates the area, in which both feet of the tennis student must stand. Especially during a forehand stroke, a certain variation possibility exists for the position of the feet so that the defined position of both feet specified according to FIG. 1 is not absolutely necessary.

The embodiments of the invention in which an exclusive property or privilege is claimed are defined as follows:

1. An exercise device for learning to guide a tennis racquet, comprising an upwardly open ball track, which has an approximate U-shape from a top view and includes two branches joined at an apex area, and a support device supporting the ball track inclined above the ground so that a lowermost point of the ball track lies in said apex area of said U-shaped ball track.

2. The exercise device according to claim 1, wherein the ball track is curved three-dimensionally by being bent approximately S-shaped in a side view with a maximum drop occurring between the apex area and free ends of the two branches.

3. The exercise device according to claim 2, wherein the free ends of the two branches of the ball track are open ended.

4. The exercise device according to claim 2, wherein the branches of the ball track have a marking thereon which increases in intensity toward their respective ends representing different speeds of a desired racquet stroke.

5. The exercise device according to claim 2, wherein each of the two branches of the ball track includes three differently marked areas representing different speeds of a desired racquet stroke.

6. The exercise device according to claim 1, wherein the ball track is asymmetrical in a top view by a first said branch being wider than a second said branch.

7. The exercise device according to claim 1, wherein the ball track is asymmetrical in a top view by a first said branch being longer than a second said branch.

8. The exercise device according to claim 1, wherein the ball track has curved inner and outer walls, the inner wall being adjacent the interior of the U-shaped ball track whereat a person stands to use the exercise device, the outer wall being remote the interior of the U-shaped ball track, the ball track having, at least at some portions, an asymmetrical cross section with the outer wall having a smaller radius of curvature than the inner wall.

9. The exercise device according to claim 1, wherein the support device includes first, second and third stands, the first stand supporting the apex area and said second and third stands respectively supporting said two branches.

10. The exercise device according to claim 9, wherein the second and third stands are elevationally adjustable.

11. The exercise device according to claim 9, wherein the first stand in is elevationally adjustable.

12. The exercise device according to claim 1, wherein the apex area includes a ball magazine.

13. The exercise device according to claim 12, wherein the ball magazine includes a storage track arranged outside and below the ball track, a supply track connected to the ball track for supplying a ball to the ball track, and a ball lifter for lifting a ball from the storage track to the supply track.

14. The exercise device according to claim 13, wherein an outer wall of the ball track has a recess adjacent the supply track.

15. The exercise device according to claim 13, wherein the ball lifter includes a pivotally supported scoop and a rotatably supported lever projecting beyond the ball track connected to the scoop for pivoting the scoop.

16. The exercise device according to claim 15, wherein the rotatably supported lever is provided on both sides of the recess, the lever being swingable into a position essentially bridging the recess.

17. The exercise device according to claim 1, wherein the branches are releasably fastened to said apex area.

* * * * *